US006074049A

United States Patent [19]

Mächler

[11] Patent Number: 6,074,049

[45] **Date of Patent: *Jun. 13, 2000**

[54] INK CARTRIDGE FOR A PRINTING HEAD OF AN INKJET PRINTER

[75] Inventor: Gordian Mächler, Altendorf, Switzerland

[73] Assignee: Pelikan Produktions AG, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 08/417,869

[22] Filed: Apr. 6, 1995

[30] Foreign Application Priority Data

Apr. 6, 1994 [DE] Germany ..... 94 05 723 U

[51] Int. Cl.[7] ..... B41J 2/175

[52] U.S. Cl. ..... 347/86

[58] Field of Search ..... 347/84–87

[56] References Cited

U.S. PATENT DOCUMENTS

| | | | |
|---|---|---|---|
| 5,119,115 | 6/1992 | Buat et al. | 347/86 |
| 5,182,581 | 1/1993 | Kashimura et al. | 347/87 |

FOREIGN PATENT DOCUMENTS

| | | | |
|---|---|---|---|
| 0 560 729 B1 | 5/1993 | European Pat. Off. . | |
| 58-59850 | 4/1983 | Japan | 347/86 |
| 6-966 | 1/1994 | Japan | 347/86 |
| 6-71900 | 3/1994 | Japan | 347/86 |
| 6-238911 | 8/1994 | Japan | 347/85 |

OTHER PUBLICATIONS

Greene et al.; "Constant–Pressure Head Ink Supply"; IBM Technical Disclosure Bulletin; vol. 15, No. 9; p. 2898, Feb. 1973.

*Primary Examiner*—N. Le
*Assistant Examiner*—Judy Nguyen
*Attorney, Agent, or Firm*—Fay, Sharpe, Fagan, Minnich & McKee, LLP

[57] ABSTRACT

An ink cartridge with an ink impregnated foam element contained therein is provided. A first opening is provided in the ink cartridge and is sealed by a cover. This cover is pierced by a tubular connector piece when the ink cartridge is inserted into a printing head. The tubular connector piece forms a seal with a sealing surface of the first opening which is formed below the cover to prevent any leakage of ink. A second opening is also formed in the ink cartridge to allow air to be delivered to the interior of the ink cartridge.

11 Claims, 4 Drawing Sheets

INK CARTRIDGE FOR A PRINTING HEAD OF AN INKJET PRINTER

BACKGROUND OF THE INVENTION

This invention relates generally to an ink cartridge and more particularly to an ink cartridge for a printing head of an ink jet printer.

As is shown in European Application EP-A-560 729, ink cartridges for ink jet printers may be formed with an opening in an end wall thereof into which a connector piece of a printing head can be sealingly inserted. The end of the connector piece is covered by a sieve which, upon insertion into the ink cartridge, slightly compresses a foam element impregnated with ink, so that ink is forced into the connector piece. However, it has been found that this apparatus is not always easily handled, and does not always supply ink reliably. Therefore, it has been proposed in European Application EP-A-560 729 to additionally install a pump in the housing of the ink cartridge to aid in reliably supplying the ink. However, this pump makes the ink cartridge very expensive.

Accordingly, it is desirable to provide an ink cartridge which is easily handled, which provides ink reliably and which is inexpensive.

SUMMARY OF INVENTION

Generally, in accordance with the present invention, an ink cartridge which is easier to handle and which supplies ink more reliably is provided. An ink impregnated foam element is contained within the ink cartridge. A first opening in the ink cartridge is dimensioned to receive a tubular connector piece. A stopper is formed with a cover and a sealing surface below the cover. The first opening is sealed by the cover. Upon insertion of the ink cartridge into a printing head the first opening receives the tubular connector piece, piercing the cover. The tubular connector piece forms a seal with the sealing surface of the first opening. The sealing surface is formed below the cover to prevent any leakage of ink. A second opening is formed in the ink cartridge to allow air to be delivered to the interior of the ink cartridge.

Accordingly, it is an object of this invention to provide an improved ink cartridge which is easier to handle.

Another object of the invention is to provide an improved ink cartridge which supplies ink more reliably.

A further object of the invention is to provide an improved ink cartridge which supplies ink more reliably and which is less expensive than prior art ink cartridges employing a pump.

Still other objects and advantages of the invention will in part be obvious and will in part be apparent from the specification and drawings.

The invention accordingly comprises the features of construction, combination of elements, and arrangement of parts which will be exemplified in the construction hereinafter set forth, and the scope of the invention will be identified in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
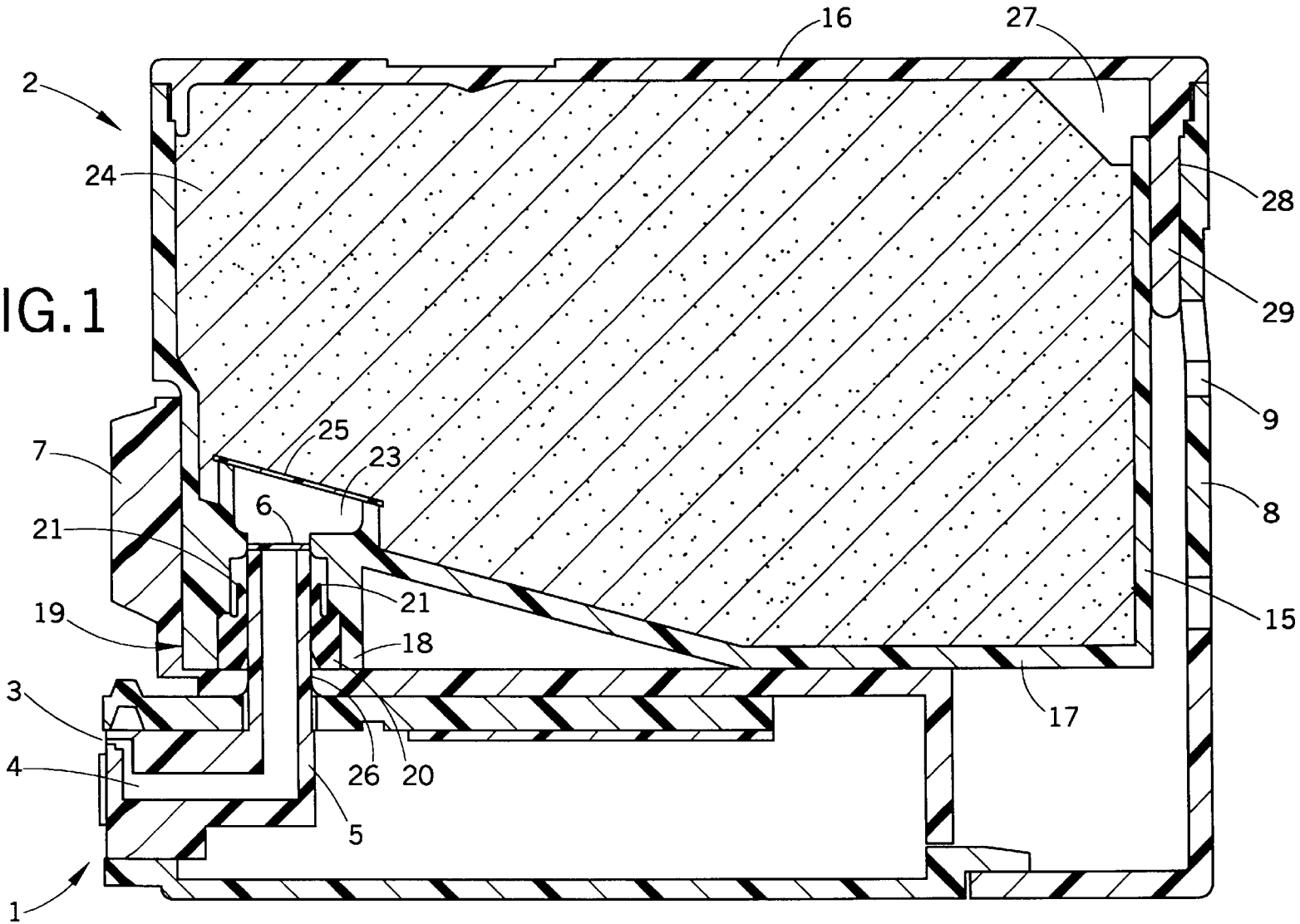
FIG. 1 is cross-sectional view of a printing head and an ink cartridge constructed in accordance with a first embodiment of the invention.

Referring first to FIG. 1, a printing head, generally indicated at 1, with a replaceable ink cartridge indicated generally at 2 is shown. Printing head 1 is formed of a casing 50, and assembly 51 and a bottom cover 52. The assembly 51 comprises a nozzle plate comprising a plurality of fine nozzles 3, each of said plurality of fine nozzles 3 being associated with an individual thermoelectric heating element and being connected to a tubular connector piece 5 via a conduit 4. A sieve 6 covers the top of connector piece 5. When a heating element is momentarily heated, a gas bubble forms thereon. The pressure from this bubble ejects an ink droplet from the associated nozzle 3. After the gas bubble collapses, ink is drawn out of connector piece 5 and into conduit 4 by the surface tension at the associated nozzle opening. This is a standard mode of operation of an ink jet printing head.

Figure 2:
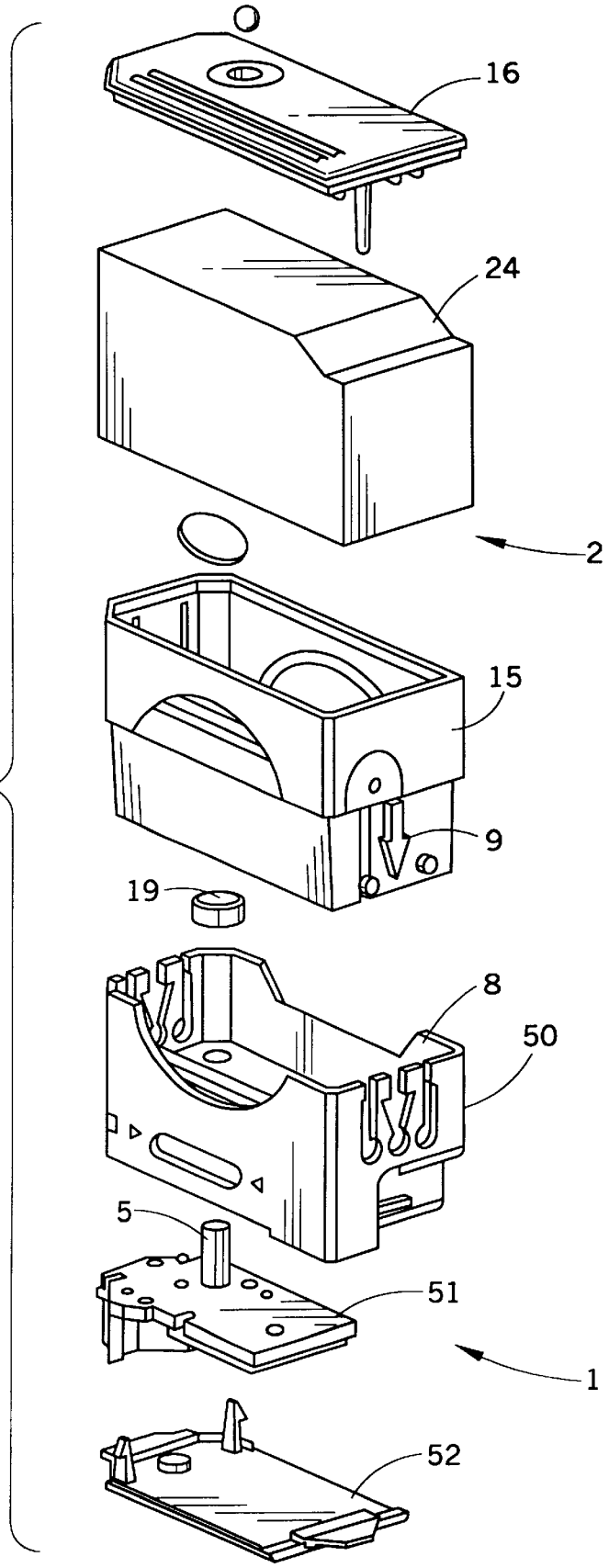
FIG. 2 an exploded perspective view of the ink cartridge of FIG. 1.
Figure 4:
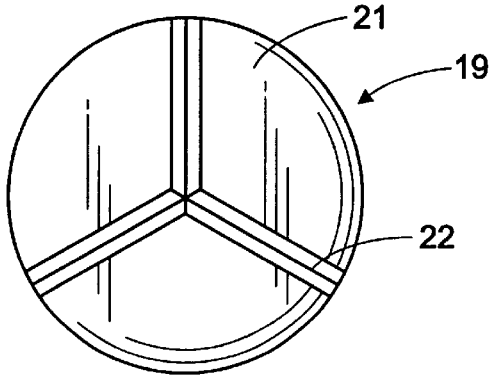
FIG. 4 is a top plan view of the stopper of FIG. 3 showing the star-shaped preset breaking notches thereon.

Referring next to FIGS. 1 and 2, ink cartridge 2 includes a housing consisting of two parts, namely a housing body 15 and, a cover 16, forming an enclosed container. A base 17 of housing 15 has a stepped hole 18 in which an elastomer sealing stopper 19 having a tubular wall 20 forming an inner sealing surface or wall 26, and a cover 21 joined integrally thereto, is contained. The inner sealing wall 26 forms a first opening of the housing. Cover 21 is formed with preset breaking notches 22 which are star-shaped, as is shown in FIG. 4.

Figure 3:
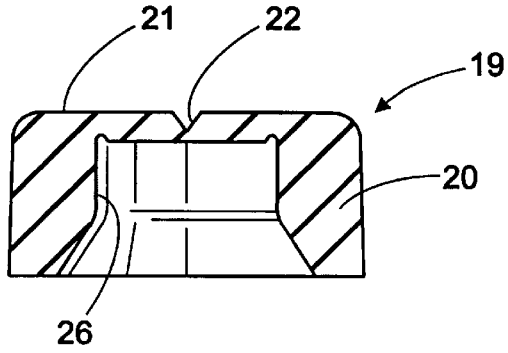
FIG. 3 is an enlarged partial cross-sectional view of the stopper of FIG. 1 before insertion of the connector piece.

To connect ink cartridge 2 to printing head 1, ink cartridge 2 is inserted into a rectangular tubular seat 7 of printing head 1 and secured with interacting snap elements 8 and 9. Referring also to FIG. 3, when ink cartridge 2 is connected to printing head 1, inner sealing wall 26 of wall 20 of ink cartridge 2 comes into contact with the outside of connector piece 5 and forms a seal therebetween before cover 21 is penetrated by the end of connector piece 5. Thus ink is retained in ink cartridge 2 after cover 21 is pierced. Sieve 6 then projects into a prechamber 23 filled with free ink, which is separated from an ink-impregnated foam element 24 by a filter 25.

A smaller cavity 27 is formed in the corner of housing body 15 opposite prechamber 23 and is vented through a vent opening. The vent opening consists of a capillary gap between a relatively long hole 28 of housing body 15 and a plug 29 of cover 16 which is inserted into long hole 28 and has a diameter slightly smaller than long hole 28.

Simple handling and reliable ink supply results since ink cartridge 2 is sealed by cover 21 as insertion of ink cartridge 2 into head 1 begins. Because cover 21 is upstream of sealing wall 26, cover 21 is not breached by connector piece 5 until after inner sealing wall 26 of wall 20 of sealing stopper 19 has come into contact with connector piece 5, and a seal has been formed therebetween. No opening needs to be uncovered (for example by removing a sealing film) before inserting ink cartridge 2 into printing head 1. Thus, it is impossible for ink to drip from any opening.

Furthermore, filter 25 reliably prevents the entry of any ink contaminants into connector piece 5, and subsequently into the fine nozzles of nozzle plate 3. Filter 25 also reduces the buildup of particles on sieve 6 of printing head 1 which would increase the resistance to the flow of ink through sieve 6 over time. Thus, the life span of printing head 1 is increased.

By accurately dimensioning long hole 28 and plug 29, a narrow capillary air inlet opening is easily formed which otherwise would be difficult to form by injection molding. The narrow capillary vent opening largely prevents the evaporation of ink from ink-impregnated foam element 24.

Furthermore, if housing body 15 is injection-molded from a relatively soft thermoplastic, sealing stopper 19 can also be made of this material and can be injection-molded integrally with housing body 15, thus decreasing the number of parts which are required to be formed.

Figure 5:
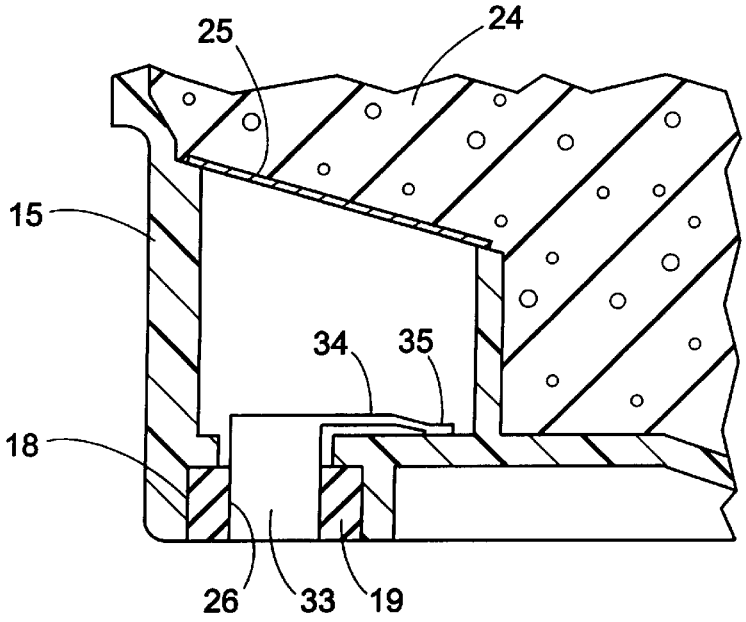
FIG. 5 is a partial cross-sectional view of an ink cartridge and printing head constructed in accordance with a second embodiment of the invention.

Now referring to FIG. 5, a second embodiment of the invention is described, like parts being given like reference numerals, the primary difference being that sealing stopper 19 is sleeve-shaped and does not have a cover 21 as shown in the first embodiment. Rather, a peg 33, which has a tab 34 protruding from its top and emerging to one side, is inserted into sealing stopper 19 from the inside. A free end 35 of tab 34 is joined to an inner side of bottom 17 of housing body 15. This joining may be done by welding. When connector piece 5 is inserted into step hole 18, the end of connector piece 5 pushes peg 33 into prechamber 23. Tab 34 prevents peg 33 from resting flat on its end surface, and possibly blocking connector piece 5 when the connector piece 5 is inserted. Thus, this second embodiment completely eliminates the entry of any air into prechamber 23 when connector piece 5 is inserted.

Figure 6:
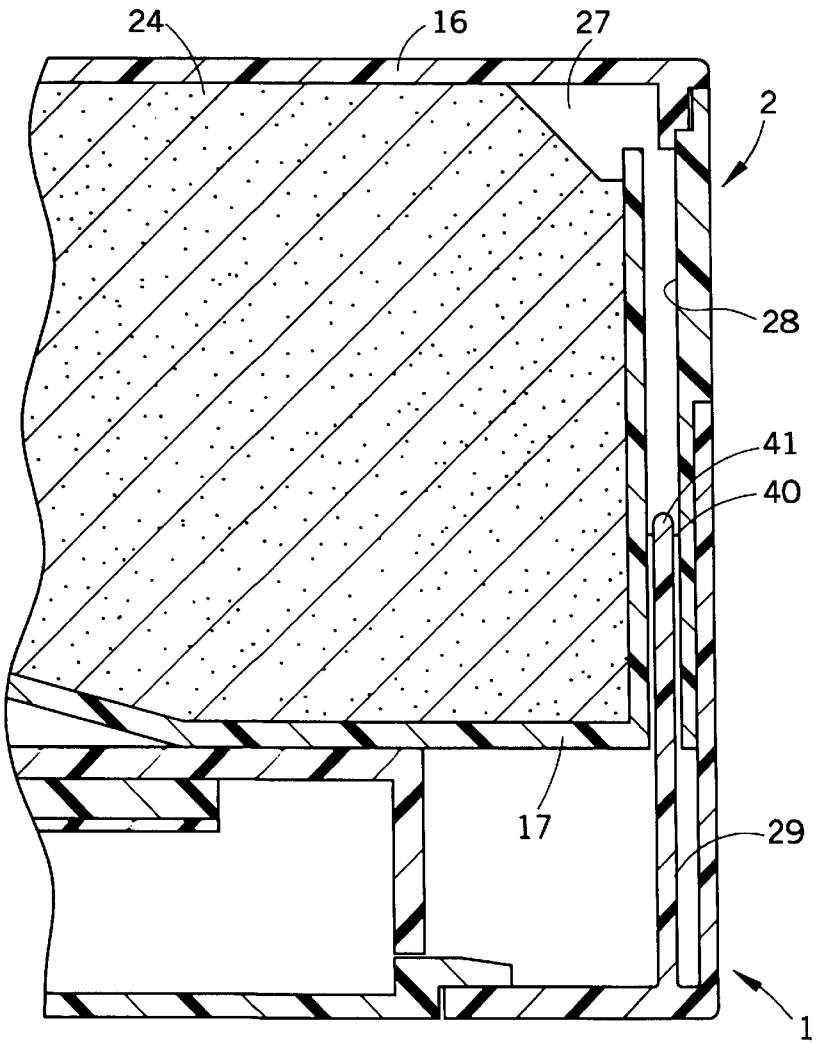
FIG. 6 is a partial cross-sectional view of an ink cartridge constructed in accordance with a third embodiment of the invention.

Reference is now made to FIG. 6 wherein a third embodiment of the invention is described, like parts being given like reference numerals. As is shown in FIG. 6, hole 28 extends downward from cover 16 and plug 29 is formed as part of printing head 1. The primary difference in this embodiment being a membrane 40 extending across hole 28. Before cartridge 2 is inserted into printing head 1, hole 28 is sealed by thin membrane 40 which is penetrated by plug 29 during insertion of ink cartridge 2 just before snap elements 8 and 9 snap ink cartridge 2 into place. At the upper end of plug 29, a lengthwise groove 41 is formed in order to ensure a connection between the capillary gap between hole 28 and plug 29, and cavity 27. Because connector piece 5 of printing head 1 penetrates into prechamber 23 before membrane 40 is penetrated and the vent opening is open, a slight pressure buildup is created in ink cartridge 2. As a result, connector piece 5 of printing head 1 becomes at least partly filled with ink which facilitates the start of the flow of ink to printing head 1.

Figure 7:
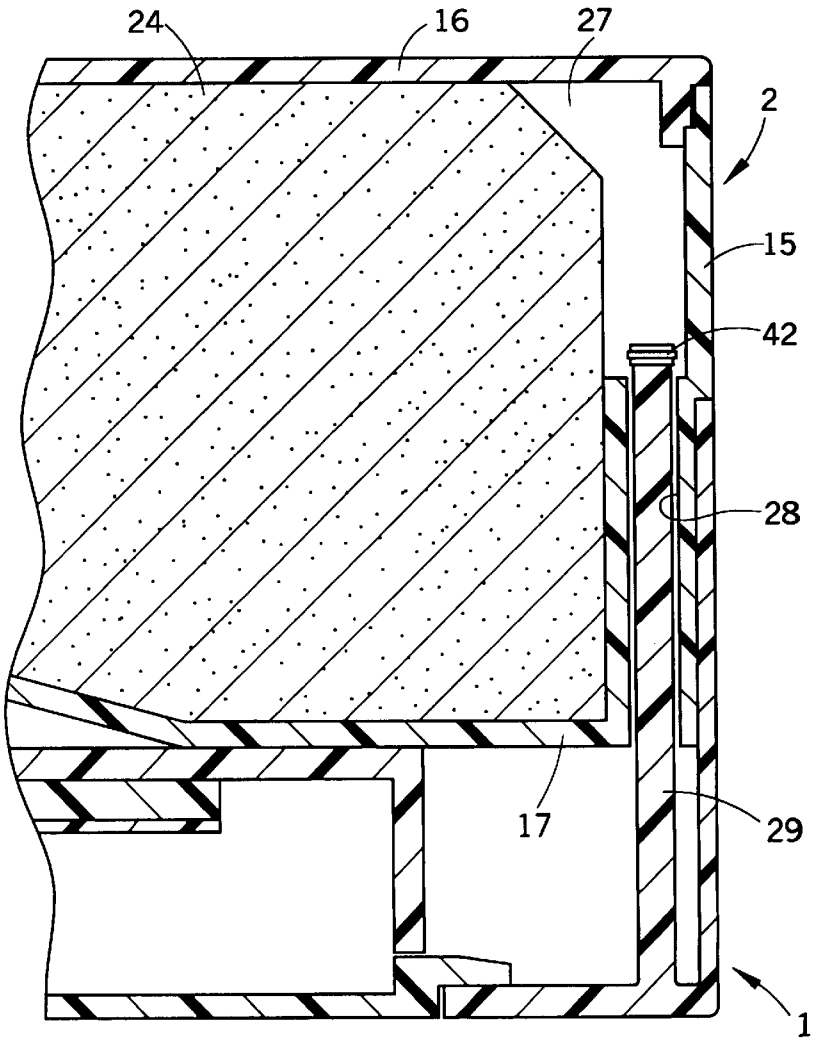
FIG. 7 is a partial cross-sectional view of an ink cartridge constructed in accordance with a fourth embodiment of the invention.

Reference is now made to FIG. 7 in which a fourth embodiment of the invention is described, like elements being given like reference numerals. The primary difference in this embodiment being an elastomer pin 42 disposed on plug 29. Before insertion of ink cartridge 2 into printing head 1, hole 28 is closed off at the lower end by an elastomer pin 42. When cartridge 2 is inserted into printing head 1, elastomer pin 42 is pushed by the end of plug 29 out of hole 28 into cavity 27 before snap elements 8 and 9 snap into place. Pin 42 thus acts as a piston during insertion of cartridge 2 into printing head 1. As a result, a higher pressure in ink cartridge 2 can be generated during insertion of the cartridge than in the third embodiment and connector piece 5 can be more completely filled with ink, thereby further facilitating the start of the flow of ink to printing head 1. This makes it possible to dispense with any priming process in the printer after changing ink tanks and before the printing head is put back into service. Alternatively, an O-ring can be formed at the end of plug 29 which comes into contact with hole 28 and forms a seal therebetween when ink cartridge 2 is being inserted into printing head 1, and which projects into cavity 27 when ink cartridge 2 is fully inserted.

The narrow capillary gap formed by relatively long hole 28 and inserted plug 29, and the spacing of connector piece 5 from foam element 24 by a filter 25 and a prechamber, can also be employed in ink cartridges of other designs, even if inner sealing wall 26 is not closed off by a cover 21 or peg 33.

It will thus be seen that the objects set forth above, and those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An ink cartridge for insertion into a printing head of an ink jet printer having a blunt tubular connector piece, comprising:

a housing having an interior and comprising a housing body and a cover element, an ink-impregnated foam element contained within said housing;

a first opening in said housing dimensioned to receive said tubular connector piece;

a cover sealing said first opening, said cover being opened upon penetration by a blunt lead end of said tubular connector piece upon insertion of said ink cartridge into said printing head;

a sealing surface in said first opening formed adjacent said cover, said sealing surface dimensioned to contact an outer surface of said tubular connector piece before the blunt lead end of said tubular connector piece penetrates said cover upon insertion of said ink cartridge into said printing head to prevent leakage of ink from said first opening;

a prechamber formed in said housing adjacent said first opening, said prechamber being filled with ink, a filter separating said ink impregnated foam element from said prechamber; and, a second opening in said housing for delivery of air to said interior of said housing, said second opening being formed as an elongated hole in one of said housing body and said cover element and a plug formed in an other one of said housing body and said cover element, said plug having a diameter slightly less than said elongated hole forming a capillary gap along a side of said plug for insertion into said elongated hole upon attaching said cover element to said housing body.

2. An ink cartridge for insertion into a printing head of an ink jet printer wherein said printing head includes a blunt tubular connector piece projecting therefrom, said ink cartridge comprising:

a housing having an interior;

a first opening in said housing dimensioned to receive the tubular connector piece;

a cover sealing said first opening wherein said cover is formed with preset breaking notches which are breakable upon penetration by a blunt lead end of said tubular connector piece to allow said blunt tubular connector piece to pass through said cover upon insertion of said ink cartridge into said printing head;

a sealing surface disposed in said first opening, said sealing surface engaging said tubular connector piece before said tubular connector piece passes through said cover upon said insertion to prevent leakage of ink from said first opening; and a second opening in said housing for delivery of air to said interior of said housing.

3. The ink cartridge of claim 2, wherein said sealing surface and said cover are cooperatively connected to form a stopper, said stopper being inserted into said first opening.

4. The ink cartridge of claim 2, further comprising an ink-impregnated foam element contained within said housing containing ink therein.

5. An ink cartridge for insertion into a printing head of an ink jet printer including a blunt tubular connector piece, comprising:

a housing having an ink reservoir;

a first opening in said housing dimensioned to receive said blunt tubular connector piece, a cover sealing said first opening, said cover being adapted to be opened by a blunt lead end of said tubular connector piece upon insertion of said ink cartridge into said printing head;

a sealing surface formed in said first opening adjacent said cover, said sealing surface dimensioned to contact an outside surface of said blunt tubular connector piece to prevent leakage of ink from said first opening before said blunt lead end of the tubular connector piece penetrates said cover upon insertion of said ink cartridge;

a second opening in said housing for delivery of air to within said housing;

a prechamber formed in said housing between said first opening and said ink reservoir, said prechamber being filled with ink; and an ink impregnated foam element contained within said housing, and a filter separating said ink-impregnated foam element from said prechamber.

6. An ink cartridge for insertion into a printing head of an ink jet printer having a tubular connector piece, comprising:

a housing having an interior defining an ink reservoir;

an opening in said housing dimensioned to receive said tubular connector piece;

a capillary air opening for delivery of air to said ink reservoir, wherein said housing comprises two parts constituting a housing body and a cover element, said capillary air opening being formed as an elongated hole defined by said housing; and a plug formed and extending from said cover, said plug having a diameter slightly less than said elongated hole and being inserted into said elongated hole upon attaching said cover to said ink cartridge forming a capillary gap between said plug and said elongated hole such that air is supplied from outside of said housing to said ink reservoir in said housing through said capillary gap formed between the plug and hole.

7. The ink cartridge of claim 6 further comprising an ink-impregnated foam element contained within said housing containing ink therein.

8. An ink cartridge for insertion into a printing head of an ink jet printer including a tubular connector piece projecting therefrom, comprising:

a housing;

a first opening in said housing dimensioned to receive the tubular connector piece; and a second opening in said housing for delivery of air to an interior of said housing, wherein said second opening is formed as an elongated hole in said housing, a plug formed integral with said printing head and having a diameter slightly less than said elongated hole, said plug being inserted into said elongated hole when said ink cartridge is inserted into said printing head.

9. The ink cartridge of claim 8, wherein said elongated hole is sealed by a membrane, said membrane being pierceable by said plug upon insertion of said ink cartridge into said printing head.

10. The ink cartridge of claim 8, further comprising a sealing member mounted on said plug wherein said plug pushes the sealing member along said elongated hole into said housing upon insertion of said ink cartridge so that said plug forces said ink out of said first opening into said tubular connector piece.

11. The ink cartridge of claim 8 further comprising an ink-impregnated foam element contained within said housing containing ink therein.

* * * * *